US009172173B2

(12) United States Patent
Yen

(10) Patent No.: US 9,172,173 B2
(45) Date of Patent: Oct. 27, 2015

(54) STRUCTURE UNIVERSAL SERIAL BUS CONNECTOR

(71) Applicant: Hsu Li Yen, Taipei County (TW)

(72) Inventor: Hsu Li Yen, Taipei County (TW)

( * ) Notice: Subject to any disclaimer, the term of this patent is extended or adjusted under 35 U.S.C. 154(b) by 34 days.

(21) Appl. No.: 14/142,068

(22) Filed: Dec. 27, 2013

(65) Prior Publication Data

US 2015/0188252 A1 Jul. 2, 2015

(51) Int. Cl.
*H01R 27/00* (2006.01)
*H01R 13/50* (2006.01)

(52) U.S. Cl.
CPC ..... *H01R 13/50* (2013.01); *H01R 27/00* (2013.01)

(58) Field of Classification Search
CPC ..... H01R 24/62; H01R 24/60; H01R 24/218; H01R 13/6658; H01R 13/502; H01R 13/6594; H01R 13/6581; H01R 13/46; H01R 13/659
USPC ..... 439/668, 638, 660, 607.01, 676
See application file for complete search history.

(56) References Cited

U.S. PATENT DOCUMENTS

| | | | | |
|---|---|---|---|---|
| 6,371,771 | B1 * | 4/2002 | Fan | 439/79 |
| 8,460,036 | B1 * | 6/2013 | Chen | 439/660 |
| 2011/0009008 | A1 * | 1/2011 | Wang | 439/660 |
| 2011/0158588 | A1 * | 6/2011 | Little et al. | 385/74 |

OTHER PUBLICATIONS

USB 3.0 connector pinout, http://web.archive.org/web/20111230011453/http://pinoutsguide.com/Slots/usb_3_0_connector_pinout.shtml, Last Updated: Oct. 18, 2010.*

* cited by examiner

*Primary Examiner* — Amy Cohen Johnson
*Assistant Examiner* — Oscar C Jimenez
(74) *Attorney, Agent, or Firm* — Rosenberg, Klein & Lee

(57) ABSTRACT

This invention relates to an improved structure of USB connector, particularly relating to the structure of USB connector its bottom having a reading slot for memory card. An insulating base having a slice extending from the insulating base, the top of an insulating base and a slice is hollowly equipped with a number of terminal grooves which are arranged every other line for inlaying USB terminals. Mainly the bottom of an insulating base is equipped with grooves whose middle is protrudently equipped with a number of inlaying strips which are arranged every other line, and the rear of the grooves is protrudently equipped with bumps which are corresponding to the inlaying strips. The spaces between each inlaying strip and each bump are provided for inlaying the connecting terminals. In addition, both sides of an insulating base are equipped with inlaying grooves for inlaying a ⊓-shape hook which is provided for pressing each connecting terminal not to be loosened. Furthermore, one side of the bottom of an insulting base is protrudently equipped with a guiding slice and inlaying groove for inlaying a top locking spring. Also, a metal shell can fixedly be inserted to an insulating base forming aforementioned a USB connector having upper slot and rear reading slot of memory card.

1 Claim, 4 Drawing Sheets

STRUCTURE UNIVERSAL SERIAL BUS CONNECTOR

BACKGROUND OF THE INVENTION

1. Technical Field

This invention herein relates to an improved structure universal serial bus (USB) connector, particularly relating to the technology field of USB connector.

2. Description of Prior Art

USB can provide with higher transmission rate, USB connector has become the mainstream connector because USB connector are now widely used as peripheral products such as mouse, keyboard, game handle, game controller, scanner, digital camera, copying machine, card reader, transferring line of hard disk, portable flash disk and network components.

A USB flash disk is provided for users in market because there are the requirements for saving various data and saving tool to be portable and small. However, the memory capacity of a USB flash disk is limited.

In view of this, aforementioned USB connector which has been widely applying to the various products relating to computers is limited by the memory space of memory capacity, furthermore, new memory card having high memory capacity its size is thin and small, therefore, in order to let the users easily take the reading and saving device to save data and extend memory spaces, the inventor has executed many researches and experiments to achieve an improved structure.

SUMMARY OF THE INVENTION

This invention relates to an improved structure universal serial bus (USB) connector, particularly relating to the structure of USB connector its bottom having a reading slot for memory card. An insulating base having a slice extending from the insulating base, the top of an insulating base and a slice is hollowly equipped with a number of terminal grooves which are arranged every other line for inlaying USB terminals. Mainly the bottom of an insulating base is equipped with grooves whose middle is protrudently equipped with a number of inlaying strips which are arranged every line, and the rear of the grooves is protrudently equipped with bumps which are corresponding to the inlaying strips. The spaces between each inlaying strip and each bump are provided for inlaying the connecting terminals. In addition, both sides of an insulating base are equipped with inlaying grooves for inlaying ⊓-shape hook which is provided for pressing each connecting terminal not to be loosened. Furthermore, one side of the bottom of an insulting base is equipped with a guiding slice and inlaying groove for inlaying a top locking spring. Also, a metal shell can fixedly be inserted to an insulating base forming aforementioned a USB connector having upper slot and rear reading slot of memory card.

The objective of this invention: this invention relates to provide with a USB connector having reading slot for inserting or replacing various memory cards which have different memory capacities forming the structure and functions of saving and reading and expending memory capacities. Said USB connector can be connected to various computer appliances for usual transferring and forming the saving and reading function. Said USB connector can be applied to USB transferring line providing with functions not only usual transferring function but also having the saving and reading the memory card, in addition, USB connector can be applied to USB flash disk unlimitedly extending memory capacities for reading and writing functions.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE INVENTION

Figure 1:
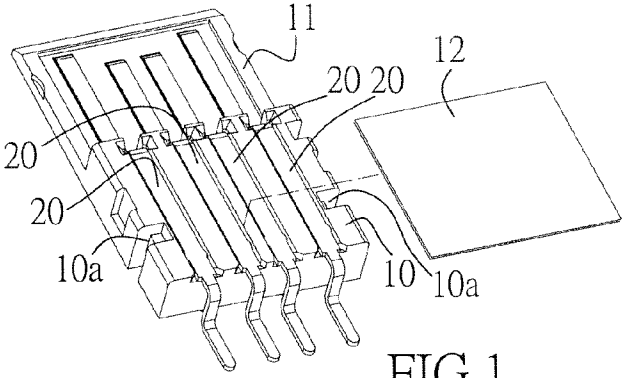
FIG. 1 is a schematic view of USB connector illustrating an insulating base combined with the USB terminal.
Figure 2:
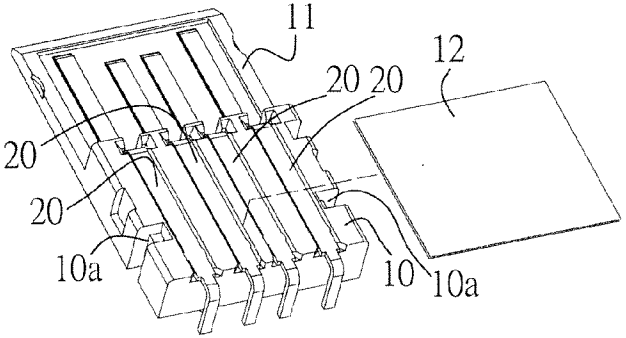
FIG. 2 is a schematic view of one another preferred embodiment of the improved structure of USB connector illustrating an insulating base combined with the USB terminal.
Figure 3:
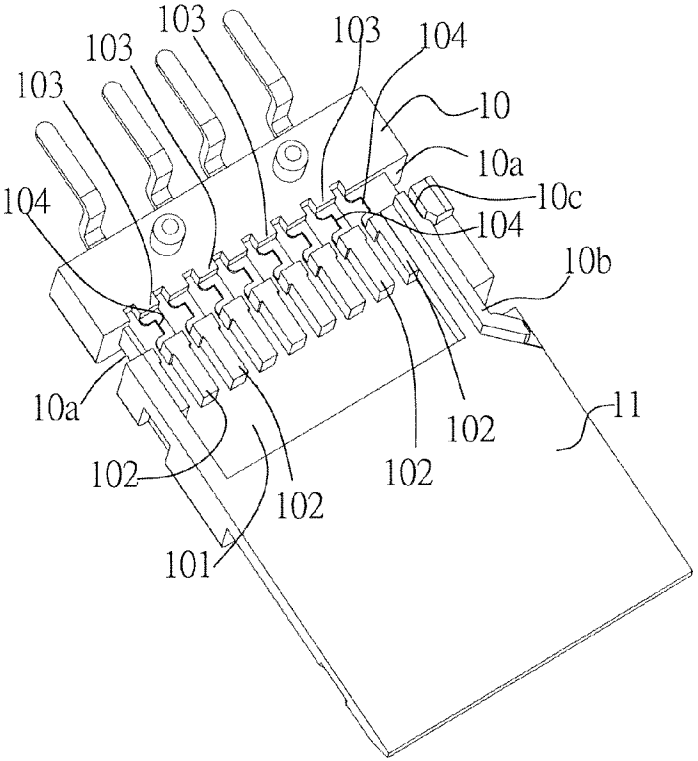
FIG. 3 is a schematic view of the improved structure of USB connector illustrating the bottom of an insulating base.

FIG. 1 is a schematic view of the improved structure of USB connector illustrating an insulating base combined with USB terminal (also referring to FIG. 2 and FIG. 3); An insulating base 10 having a slice 11 extending from the front of an insulating base, the top of an insulating base 10 and a slice 11 is hollowly equipped with a number of terminal grooves which are arranged every other line for inlaying USB terminals 20, and sticking an insulating film 12; the welding rod of the terminal of the USB terminal 20 can be foldable or straight inserted (also referring to FIG. 2).

FIG. 3 is a schematic view of the improved structure of USB connector illustrating the bottom of an insulating base; mainly the bottom of an insulating base 10 is equipped with grooves 101 whose middle is protrudently equipped with a number of inlaying strips 102 which are arranged every other line, and the rear of the grooves 101 is protrudently equipped with bumps 103 which are corresponding to the inlaying strips 102, furthermore, an inlaying hole 104 is equipped between the inlaying strip 102 and the bump 103 (also referring to FIG. 1 and FIG. 2), in addition, both sides of an insulating base 10 are equipped with inlaying grooves 10*a*, and one side of the bottom of an insulting base 10 is equipped with a guiding slice 10*b* whose terminal having a inlaying groove 10*c*.

Figure 4:
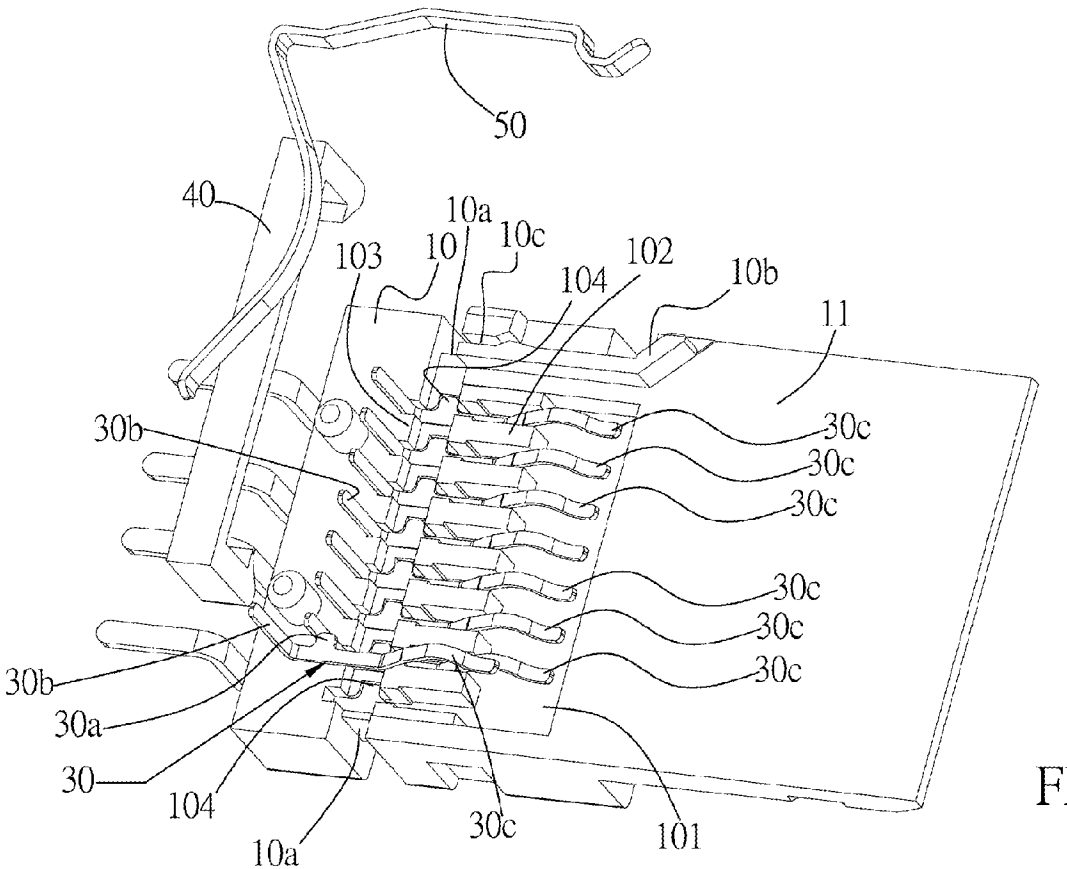
FIG. 4 is a schematic view of the improved structure of USB connector illustrating the assembly of the USB connector according to one preferred embodiment.
Figure 5:
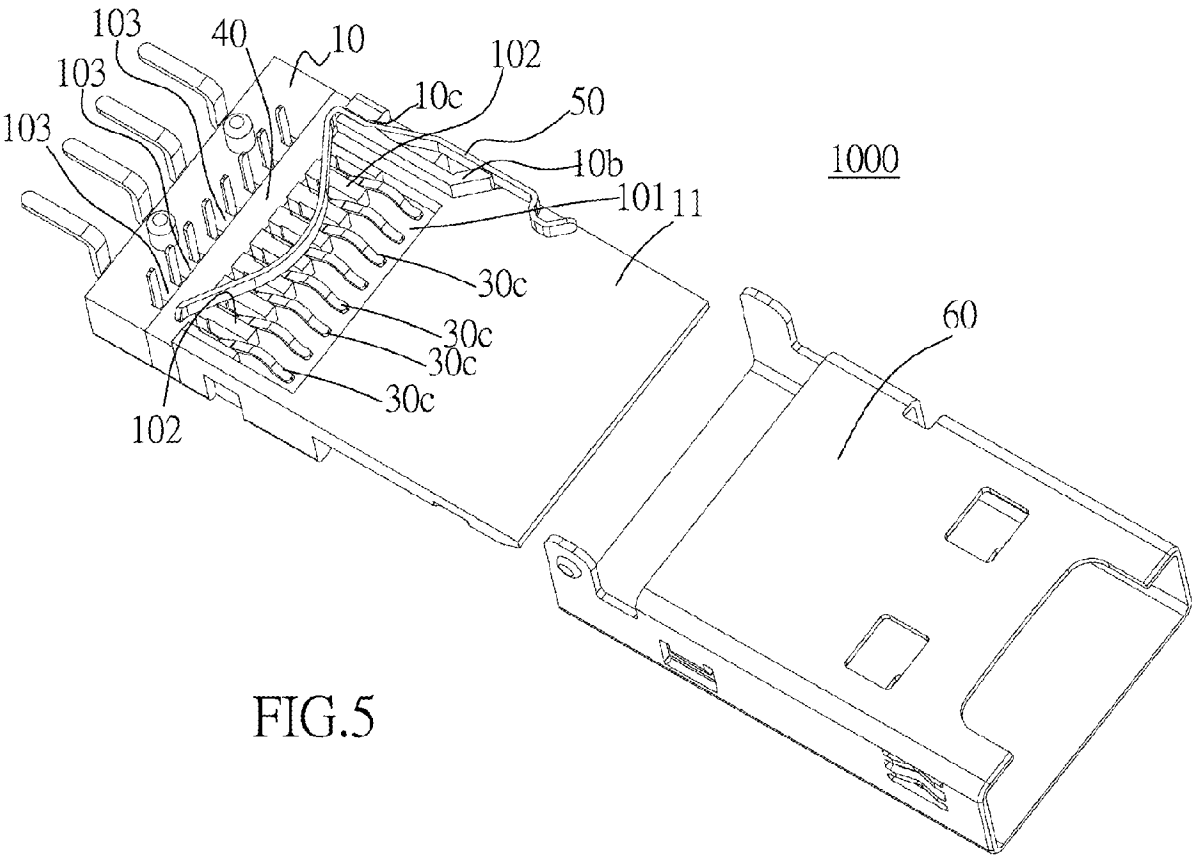
FIG. 5 is a schematic view of the improved structure of USB connector illustrating the assembly of the USB connector according to one another preferred embodiment.
Figure 6:
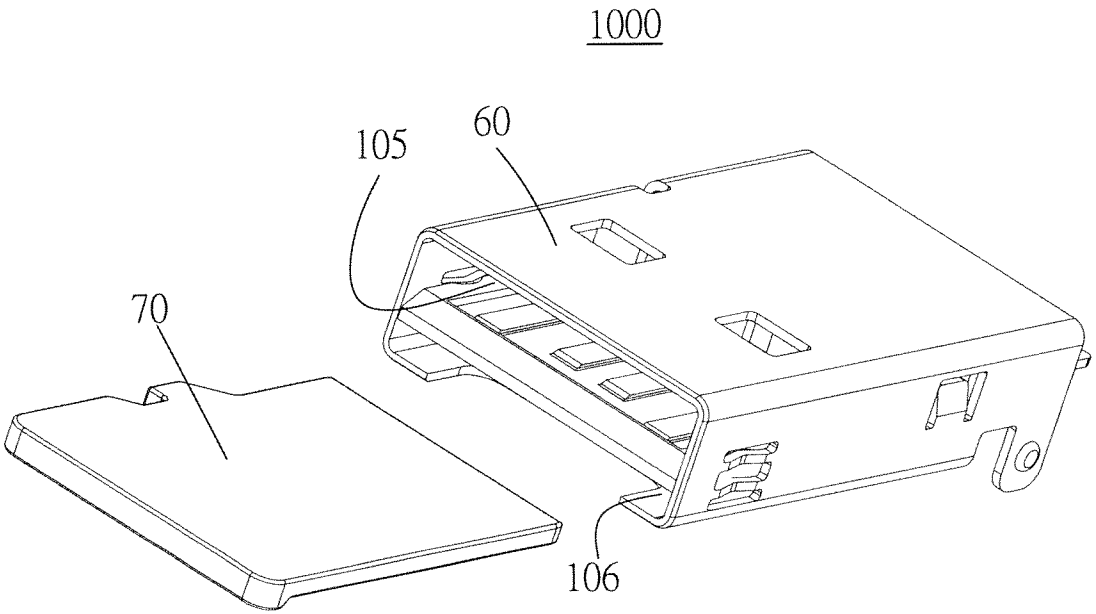
FIG. 6 is a schematic view of the improved structure of USB connector illustrating inserting the memory card.

FIG. 4 is a schematic view of the improved structure of USB connector illustrating the assembly of the USB connector according to one preferred embodiment (also referring to FIG. 5); an insulating base 10 its spaces between each inlaying strip 102 and each bump 103 are provided for inlaying the connecting terminals 30; furthermore, an inlaying hole 104 which is positioned between the inlaying strip 102 and the bump 103 is provided for positioning the protrudent slice 30*a* located on middle of the connecting terminal 30. In addition, the inlaying grooves 10*a* of both sides of an insulating base 10 (also referring to FIG. 1 and FIG. 3) is provided for inlaying a ⊓-shape hook 40 which is provided for pressing each connecting terminal 30 not to be loosened. Furthermore, one side of the bottom of an insulting base 10 is protrudently equipped with a guiding slice 10*b* its inlaying groove 10*c* provided for inlaying a top locking spring 50. Also, a metal shell 60 can fixedly be inserted to an insulating base 10 (also referring to FIG. 6) forming a USB connector 1000 having upper slot 105 and rear reading slot 106 of memory card for inserting memory card 70.

Referring to FIG. 4, the middle of the connecting terminal 30 is equipped with a protrudent slice 30*a* its front end having a top connecting end 30*c*, and its end is folded to be welding rod 30*b*.

The structure of this invention can achieve the functions mentioned above and undisclosed in public conforming to utility and novelty so that the applicant applies for a patent and requests prompt examination for granting.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims.

What is claimed is:

1. A universal serial bus (USB) connector comprising:

an insulating base having a tongue portion extending from a front end of the insulating base, a top end of the insulating base and the tongue portion is equipped with a number of terminal grooves for inlaying USB terminals, and attaching an insulating film over the USB terminals;

a bottom end of the insulating base being equipped with grooves whose middle is protrudently equipped with a plurality of inlaying strips, and a rear end of the grooves being protrudently equipped with projections corresponding to the inlaying strips;

an inlaying hole being equipped between the inlaying strips and corresponding projections;

opposing sides of the insulating base being equipped with inlaying grooves;

one side of the bottom surface of the insulating base being protrudently equipped with a guiding protrusion and an inlaying guiding groove positioned at an end of the guiding protrusion;

a substantially U-shaped hook;

a top locking spring;

a plurality of connecting terminals;

a middle of each of the connecting terminals being equipped with a protrudent tab, a front end of each of the connecting terminals having a resilient top surface connecting end, and a rear terminal end being folded to be a welding rod;

the bottom end of the insulating base having valleys between each of the inlaying strips and each of the projections provided for inlaying the connecting terminals;

the inlaying hole being positioned between the inlaying strip and the bump is projection and being provided for positioning the protrudent slice tab positioned at the middle of the connecting terminal;

the inlaying grooves of both sides of the insulating base being provided for inlaying the substantially U-shaped hook, provided for pressing each connecting terminal in order not to be loosened;

one side of the bottom surface of the insulting base being protrudently equipped with a second guiding protrusion, the inlaying guiding groove being provided for inlaying the top locking spring; and a metal shell being fixedly inserted to the insulating base forming a connector having an upper slot and a rear slot for inserting a memory card.

* * * * *